US006524444B2

(12) United States Patent
Brauns et al.

(10) Patent No.: US 6,524,444 B2
(45) Date of Patent: Feb. 25, 2003

(54) REMOVABLE DOCTOR BLADE HOLDER

(75) Inventors: Allen J. Brauns, Sturbridge, MA (US); Robert A. Reid, Charlton City, MA (US); Ronald F. Goodnow, Leicester, MA (US)

(73) Assignee: Kadant Web Systems Inc., Auburn, MA (US)

( * ) Notice: Subject to any disclaimer, the term of this patent is extended or adjusted under 35 U.S.C. 154(b) by 0 days.

(21) Appl. No.: 09/841,406

(22) Filed: Apr. 24, 2001

(65) Prior Publication Data

US 2002/0153114 A1 Oct. 24, 2002

(51) Int. Cl.[7] ..... B31F 1/12

(52) U.S. Cl. ..... 162/281; 118/261; 118/126; 118/413; 15/256.51; 101/157

(58) Field of Search ..... 162/281; 118/261, 118/126, 413; 15/256.51; 101/157

(56) References Cited

U.S. PATENT DOCUMENTS 5,980,692 A * 11/1999 Goodnow et al. ..... 162/281

* cited by examiner

*Primary Examiner*—Steven P. Griffin
*Assistant Examiner*—Mark Halpern
(74) *Attorney, Agent, or Firm*—Samuels, Gauthier & Stevens

(57) ABSTRACT

In a paper machine having a roll rotating about an axis extending in a cross machine direction, and having a doctor blade applied to the roll surface by a blade holder parallel to the axis and carried on a doctor back, an apparatus is provided for accommodating relative movement between the blade holder and the doctor back in the cross machine direction during mounting and removal of the blade holder. The apparatus comprises a rail fixed to the doctor back and extending longitudinally in the cross machine direction. A groove extends along the length of the guide rail. The groove has a bottom, a width measured between confronting sides, and a top defined by ledges projecting inwardly from the sides, with inner edges spaced one from the other to define a slot that underlies the blade holder and has a width narrower than the width of the groove. A plurality of shafts are spaced along the length of the blade holder and project downwardly through the slot and into the groove. First and second independently rotatable elements are carried by each of the shafts. The first rotatable elements are located in the slot and are dimensioned to contact the inner edges of the ledges, and the second rotatable elements are located in the groove and are dimensioned to contact the undersides of the ledges.

4 Claims, 2 Drawing Sheets

REMOVABLE DOCTOR BLADE HOLDER

BACKGROUND OF THE INVENTION

1. Field of the Invention

This invention relates generally to doctors used in papermaking machines, and is concerned in particular with the provision of a blade holder which is readily separable from the doctor back and removable from the papermaking machine for cleaning, inspection and repair.

2. Description of the Prior Art

The main components of a doctor system include the doctor blade, the blade holder, the doctor back and the loading mechanism. The doctor blade keeps the roll clean and/or sheds the sheet. It must be perfectly flat, straight and parallel, and its composition must be compatible with the roll to be doctored.

The blade holder exerts a uniform, designated load pressure on the blade. It holds the blade firmly against the roll, accommodates roll irregularities and, within limits, compensates for thermal expansion.

The doctor back is in essence the backbone of the doctor. It serves as the support structure for the blade holder. The loading mechanism pivots the doctor back to load the doctor blade against the roll.

Doctor blade holder designs used in recent years are more complex and have more components than the simpler blade holders used in the past. As a result, the more recent holder designs require more routine cleaning and maintenance.

As disclosed for example in U.S. Pat. No. 5,980,692 (Goodnow et al.), it is known to provide removable blade holders which allow for cleaning and maintenance to be performed off line while the papermachine continues to operate with a replacement blade holder.

Experience has indicated, however, that removal of the blade holder is sometimes made difficult due to frictional resistance between mating sliding surfaces.

SUMMARY OF THE INVENTION

The present invention addresses this problem by mechanically interlocking the blade holder to the doctor back with rotatable elements. The rotatable elements are strategically positioned to reduce frictional resistance to blade holder removal and replacement.

This and other objectives, features and advantages of the present invention will now be described in greater detail with reference to the accompanying drawings, wherein:

DESCRIPTION OF PREFERRED EMBODIMENT

Figure 1:
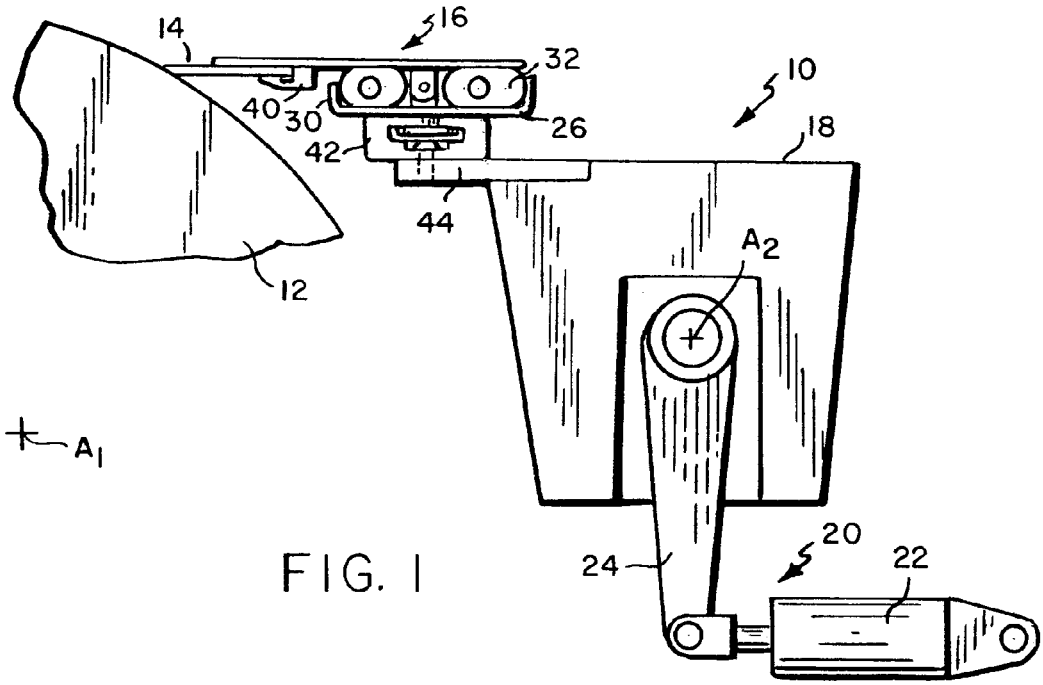
FIG. 1 is a side view of a doctor assembly including a removable doctor blade holder in accordance with the present invention.

With references initially to FIG. 1, a doctor assembly in accordance with the present invention is generally depicted at 10 adjacent to a papermachine roll 12. Roll 12 is driven by conventional means (not shown) for rotation about an axis $A_1$ extending in the cross-machine direction. The doctor assembly includes a doctor blade 14, a blade holder 16, a doctor back 18, and a loading mechanism 20. The doctor back is mounted on the papermachine frame for pivotal movement about an axis $A_2$ extending in the cross-machine direction parallel to the rotational axis $A_1$ of roll 12. The loading mechanism 20 includes a piston-cylinder unit 22 acting through lever arm 24 to pivot the doctor back 18 about its axis $A_2$ in order to load the doctor blade 14 against the surface of the roll 12.

Figure 3:
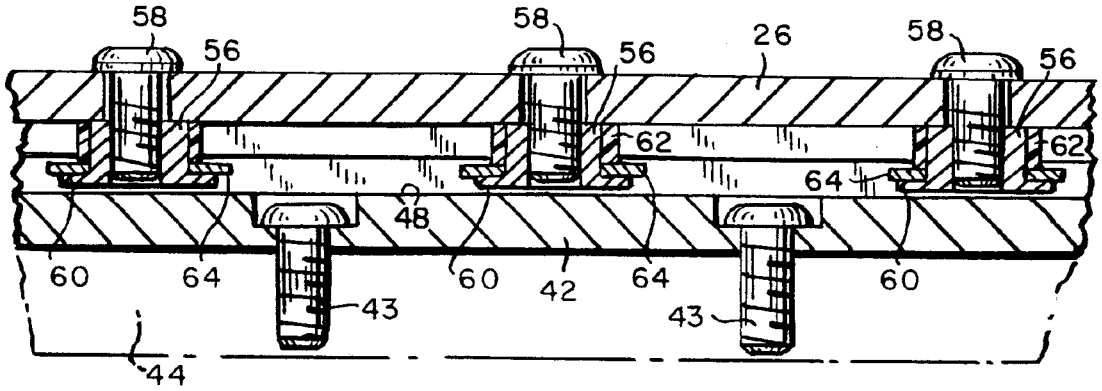
FIG. 3 is a longitudinal sectional view taken along line 3—3 of FIG. 2.
Figure 2:
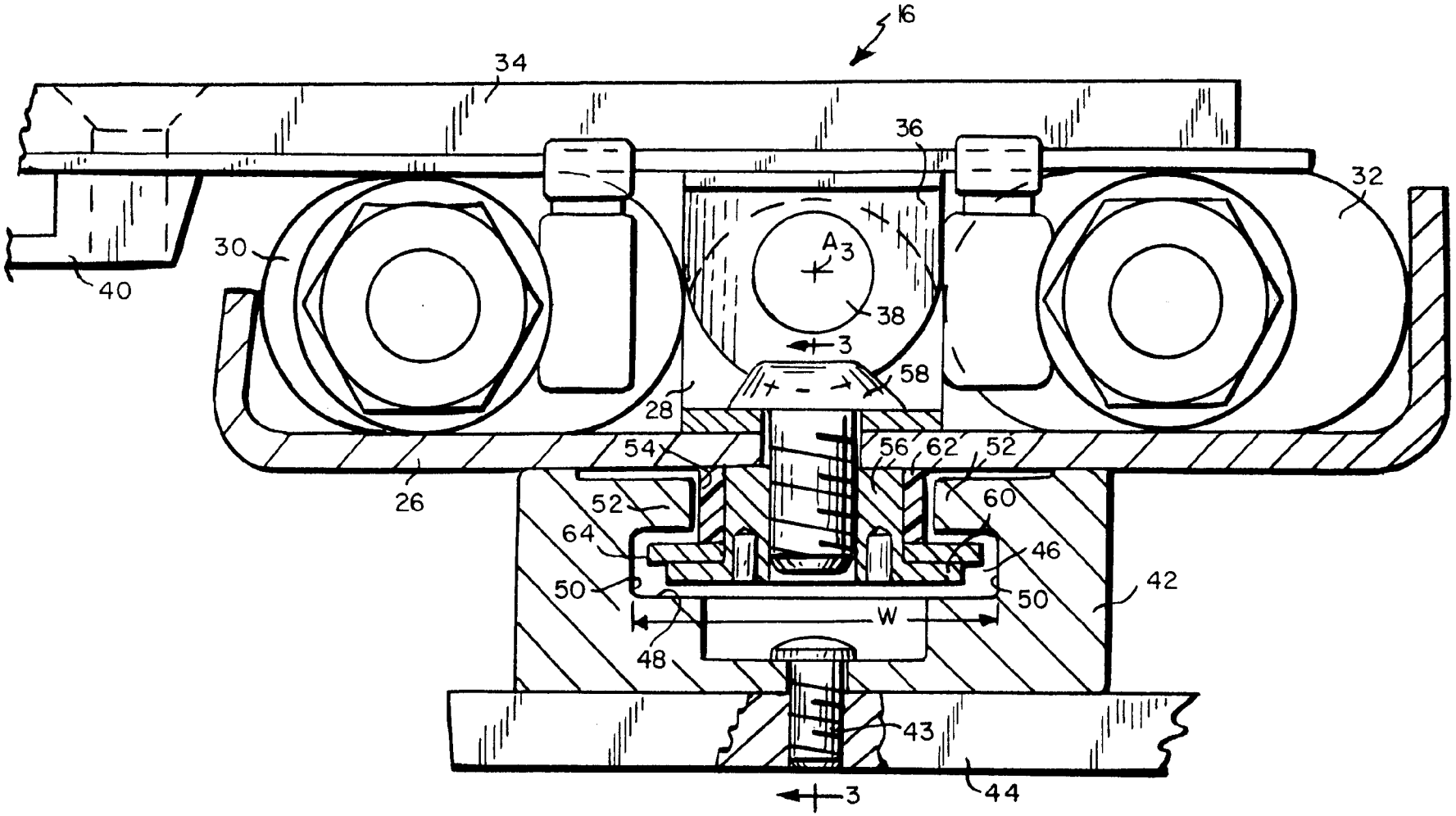
FIG. 2 is an enlarged cross sectional view taken through the blade holder and its associated mounting components.

With reference additionally to FIGS. 2 and 3, it will be seen that the blade holder 16 includes a tray 26 with upstanding brackets 28 located between an unloading tube 30 and a loading tube 32. A top pressure plate 34 overlies the tubes 30, 32 and has depending brackets 36 which are connected to the brackets 28 by a rod 38 for pivotal movement about a third axis A3 parallel to axes $A_1$ and $A_2$.

Fingers 40 cooperate with the underside of the top pressure plate 34 to retain the doctor blade 14 in its forwardly extending position. The tubes 30, 32 are fluid actuated with tube 32 serving to coact with the force applied by loading mechanism 20 to apply the blade 14 to the surface of the roll 12. Tube 30 serves to unload the blade from the roll surface, in addition to acting as a front seal.

A rail 42 is fixed by means of screws 43 to a shelf 44 projecting forwardly from and forming a part of the doctor back 18. The rail extends in the cross machine direction and is provided with a groove 46 along its length. The groove 46 has a bottom 48, a width "w" measured between confronting sides 50, and a top defined by ledges 52 projecting inwardly from the sides 50 and having inner edges spaced one from the other to define a slot 54 underlying the blade holder. Slot 54 communicates with and has a width narrower than that of the groove 46.

A plurality of hollow stub shafts 56 are spaced along the length of the blade holder. The shafts project downwardly from the underside of the blade holder through slot 54 into groove 46 and are secured in place by machine screws 58 or the like. The lower ends of the stub shafts 56 have integrally formed radially projecting circular collars 60 that are spaced beneath the underside of the blade holder. First rotatable elements comprising tubular sleeves 62 and second rotatable elements comprising discs 64 are received on the shafts 56 and are axially confirmed between the underside of the blade holder and the circular shaft collars 60. The sleeves 62 and discs 64 are rotatable independently of each other, the former being located between the inner edges of the ledges 52, and the latter projecting beneath the underside of the ledges.

When the blade holder is mounted as shown and in service, the stub shafts 56 and their respective sleeves 62 and discs 64 coact with adjacent surfaces of the rail to establish the requisite mechanical interengagement. During removal and replacement of the blade holder, the sleeves 62 and discs 64 rotatably contact the same surfaces and are free to rotate with independent surface velocities, thereby significantly reducing frictional resistance to movement of the blade holder into and out of its operative position on the doctor back.

In light of the foregoing, it will now be appreciated by those skilled in the art that various changes and modifications may be made to the embodiment herein chosen for purposes of disclosure without departing from the spirit and scope of the appended claims, and the invention is not limited in use to any particular blade holder design.

We claim:

1. In a paper machine having a roll rotating about an axis extending in a cross machine direction, and having a doctor blade applied to the roll surface by a blade holder parallel to said axis and carried on a doctor back, an apparatus for accommodating relative movement between the blade holder and the doctor back in the cross machine direction during mounting and removal of the blade holder, said apparatus comprising:

a rail fixed to the doctor back and extending longitudinally in the cross machine direction;

a groove in said rail extending along the length thereof, said groove having a bottom, a width measured between confronting sides, and a top defined by ledges projecting inwardly from said sides, said ledges having inner edges spaced one from the other to define a slot underlying said blade holder and having a width narrower than the width of said groove;

a plurality of shafts spaced along the length of said blade holder and projecting downwardly therefrom through said slot and into said groove; and first and second independently rotatable elements carried by each of said shafts, said first rotatable elements being located in said slot and being dimensioned to contact the inner edges of said ledges, and said second rotatable elements being located in said groove and being dimensioned to contact the undersides of said ledges.

2. The apparatus of claim 1 wherein said shafts include radially projecting collars spaced beneath an underside of said blade holder, and wherein said first and second rotatable elements are axially confined between said collars and said underside.

3. The apparatus of claim 1 or 2 wherein said first rotatable elements comprise tubular sleeves.

4. The apparatus of claim 3 wherein said second rotatable elements comprise discs.

* * * * *